US009048049B2

(12) United States Patent
Kodama

(10) Patent No.: US 9,048,049 B2
(45) Date of Patent: Jun. 2, 2015

(54) ELECTROMAGNETIC OPENING/CLOSING DEVICE

(75) Inventor: Kazuhiro Kodama, Hokkaido (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 97 days.

(21) Appl. No.: 14/004,895

(22) PCT Filed: Mar. 7, 2012

(86) PCT No.: PCT/JP2012/055791

§ 371 (c)(1),
(2), (4) Date: Sep. 12, 2013

(87) PCT Pub. No.: WO2012/128039

PCT Pub. Date: Sep. 27, 2012

(65) Prior Publication Data

US 2014/0002946 A1 Jan. 2, 2014

(30) Foreign Application Priority Data

Mar. 22, 2011 (JP) ..... 2011-063234

(51) Int. Cl.

| | |
|---|---|
| ***H01H 47/14*** | (2006.01) |
| ***H01H 47/00*** | (2006.01) |
| ***H01H 1/00*** | (2006.01) |
| ***H01H 50/54*** | (2006.01) |

(52) U.S. Cl.

CPC ..... *H01H 47/00* (2013.01); *H01H 1/0015* (2013.01); *H01H 47/002* (2013.01); *H01H 50/54* (2013.01)

(58) Field of Classification Search

USPC ..... 361/139, 160, 168.1

See application file for complete search history.

(56) References Cited

U.S. PATENT DOCUMENTS

| | | | | |
|---|---|---|---|---|
| 7,298,148 | B2 * | 11/2007 | Drake et al. | 324/421 |
| 2006/0114635 | A1 * | 6/2006 | Laurent et al. | 361/160 |

FOREIGN PATENT DOCUMENTS

| | | | |
|---|---|---|---|
| JP | 62-43026 | A | 2/1987 |
| JP | 02-129826 | A | 5/1990 |
| JP | 03-117318 | A | 5/1991 |
| JP | 2009-230921 | A | 10/2009 |

OTHER PUBLICATIONS

International Search Report issued in International Application No. PCT/JP2012/055791 with Date of mailing May 22, 2012.

* cited by examiner

*Primary Examiner* — Danny Nguyen

(74) *Attorney, Agent, or Firm* — McDermott Will & Emery LLP

(57) ABSTRACT

A malfunction determining unit 7 compares an absolute value of the difference between a first count and a second count stored in a storage unit 8 with a predetermined threshold. If the absolute value is less than a predetermined upper limit, the malfunction determining unit determines that a contact unit 1 has no malfunction. If the absolute value is the upper limit or more, the malfunction determining unit 7 determines that the contact unit 1 has malfunction, and supplies the determination result to a control unit 3. The control unit 3 allows an output unit 10 to output a malfunction detecting signal if receiving the determination result indicating the presence of malfunction from the malfunction determining unit 7.

13 Claims, 2 Drawing Sheets

ELECTROMAGNETIC OPENING/CLOSING DEVICE

RELATED APPLICATIONS

This application is the U.S. National Phase under 35 U.S.C. §371 of International Application No. PCT/JP2012/055791, filed on Mar. 7, 2012, which in turn claims the benefit of Japanese Application No. 2011-063234, filed on Mar. 22, 2011, the disclosures of which are incorporated by reference herein.

TECHNICAL FIELD

The invention relates to an electromagnetic opening/closing device such as an electromagnetic relay or the like.

BACKGROUND ART

For example, Japanese Patent Application Publication No. 2009-230921 (hereafter "Document 1") discloses a prior art of electromagnetic opening/closing device. In the device described in Document 1, a relay unit (an electromagnetic relay) is put in a case made from synthetic resin, and a pair of main terminals and a pair of coil terminals are protruded from the case. The pair of main terminals is connected to contacts of the relay unit, and the pair of coil terminals is connected to a coil for an electromagnet of the relay unit. In addition, the pair of main terminals is connected to a power supply line from a power supply to a load(s). The relay unit (the electromagnetic opening/closing device) is turned on when an excitation current flows between the pair of coil terminals, while the relay unit (the device) is turned off when no excitation current flows between the pair of coil terminals. That is, the electromagnetic opening/closing device is turned on, thereby closing the power supply line from the power supply to the load, while the device is turned off, thereby opening the power supply line.

In such electromagnetic opening/closing devices, malfunction of contacts (a stationary contact and a moving contact) such as contact wear, contact weld or the like may occur resulting from aged deterioration, usage count (the number of times of opening/closing).

SUMMARY OF INVENTION

The present invention has been achieved in view of the above circumstances, and an object thereof is to make it possible to detect that malfunction occurs in contacts.

The present invention is an electromagnetic opening/closing device (A) that comprises a (at least one) stationary contact (1A) and a moving contact (1B), and is configured to open or close the stationary contact (1A) and the moving contact (1B) in accordance with an exterior command for opening or closing the stationary contact (1A) and the moving contact (1B). The electromagnetic opening/closing device (A) comprises a first measurement unit (5), a second measurement unit (6), a determination unit (7) and an output unit (10). The first measurement unit (5) is configured to obtain a first count based on the number of times an exterior command has been input. The second measurement unit (6) is configured to obtain a second count based on the number of times the stationary contact (1A) and the moving contact (1B) have been actually opened or closed. The determination unit (7) is configured to determine a state of the stationary contact (1A) and the moving contact (1B) based on a difference between the first count and the second count. The output unit (10) is configured to supply an exterior with a determination result by the determination unit (7).

In an embodiment, the determination unit (7) is configured to determine that malfunction is present in the stationary contact (1A) and the moving contact (1B) if an absolute value of said difference is equal to or more than a predetermined upper limit.

In an embodiment, the determination unit (7) is configured to determine that malfunction is present in the stationary contact (1A) and the moving contact (1B) if an absolute value of said difference is equal to or more than a predetermined upper limit during a set time (Tth) from an input point of the exterior command.

In an embodiment, the first measurement unit (5) is configured to change the first count based on the number of times a close control signal has been input if the exterior command is the close control signal. The close control signal is a signal for closing the stationary contact (1A) and the moving contact (1B). The second measurement unit (6) is configured: to change, to a specified value, the number of times the stationary contact (1A) and the moving contact (1B) have been actually closed during a first set time (Tth1) from an input point of the close control signal; to change the second count by the specified value regardless of the number of times the stationary contact (1A) and the moving contact (1B) have been actually opened and closed during the first set time (Tth1); and to change the second count by the specified value whenever the stationary contact (1A) and the moving contact (1B) are actually opened and then closed after an elapse of the first set time (Tth1).

In an embodiment, the first measurement unit (5) is configured to add, to the first count, the number of times a close control signal has been input if the exterior command is the close control signal. The close control signal is a signal for closing the stationary contact (1A) and the moving contact (1B). The second measurement unit (6) is configured: to change, to a specified value, the number of times the stationary contact (1A) and the moving contact (1B) have been actually closed during a first set time (Tth1) from an input point of the close control signal; to add the specified value to the second count regardless of the number of times the stationary contact (1A) and the moving contact (1B) have been actually opened and closed during the first set time (Tth1); and to add the specified value to the second count whenever the stationary contact (1A) and the moving contact (1B) are actually opened and then closed after an elapse of the first set time (Tth1).

In an embodiment, the determination unit (7) is configured to output a predetermined first determination result if an absolute value of said difference is equal to or more than a first upper limit.

In an embodiment, the first measurement unit (5) is configured to change the first count based on the number of times an open control signal has been input if the exterior command is the open control signal. The open control signal is a signal for opening the stationary contact (1A) and the moving contact (1B). The second measurement unit (6) is configured to change the second count by a second specified value when the stationary contact (1A) and the moving contact (1B) have been actually opened during a second set time (Tth2) from an input point of the open control signal.

In an embodiment, the first measurement unit (5) is configured to subtract, from the first count, the number of times an open control signal has been input if the exterior command is the open control signal. The open control signal is a signal for opening the stationary contact (1A) and the moving contact (1B). The second measurement unit (6) is configured to subtract a second specified value from the second count when the stationary contact (1A) and the moving contact (1B) have been actually opened during a second set time (Tth2) from an input point of the open control signal.

In an embodiment, the determination unit (7) is configured to output a predetermined second determination result if an absolute value of said difference is equal to or more than a second upper limit.

In an embodiment, the first count includes a first count for close control signal. The exterior command comprises a close control signal for closing the stationary contact (1A) and the moving contact (1B). The first measurement unit (5) is configured to change the first count for close control signal based on the number of times a close control signal has been input if the exterior command is the close control signal. The second count includes a second count for close control signal. The second measurement unit (6) is configured: to change, to a specified value, the number of times the stationary contact (1A) and the moving contact (1B) have been actually closed during a first set time (Tth1) from an input point of the close control signal; to change the second count for close control signal by the specified value regardless of the number of times the stationary contact (1A) and the moving contact (1B) have been actually opened and closed during the first set time (Tth1); and to change the second count for close control signal by the specified value whenever the stationary contact (1A) and the moving contact (1B) are actually opened and then closed after an elapse of the first set time (Tth1).

In an embodiment, the determination unit (7) is configured to output a predetermined first determination result if an absolute value of a difference between the first count for close control signal and the second count for close control signal is equal to or more than a first upper limit for close control signal.

In an embodiment, the first count includes a first count for open control signal. The exterior command comprises an open control signal for opening the stationary contact and the moving contact. The first measurement unit (5) is configured to change the first count for open control signal based on the number of times an open control signal has been input if the exterior command is the open control signal for opening the stationary contact (1A) and the moving contact (1B). The second count includes a second count for open control signal. The second measurement unit (6) is configured to change the second count for open control signal by a second specified value when the stationary contact (1A) and the moving contact (1B) have been actually opened during a second set time (Tth2) from an input point of the open control signal.

In an embodiment, the determination unit (7) is configured to output a predetermined second determination result if an absolute value of a difference between the first count for open control signal and the second count for open control signal is equal to or more than a first upper limit for open control signal.

Advantageous Effects of Invention

The electromagnetic opening/closing device of the present invention can detect that malfunction occurs in contacts.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS

Figure 1:
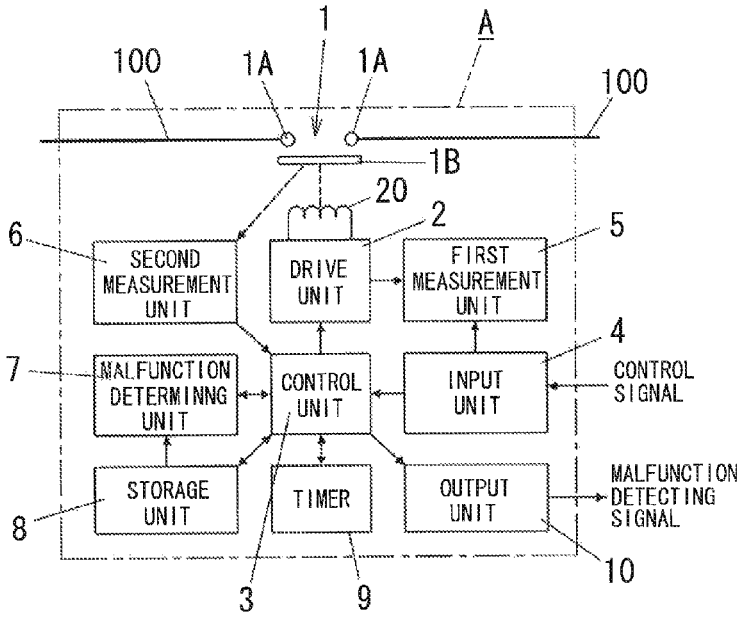
FIG. 1 is a block diagram of an embodiment of the present invention.

FIG. 1 shows an electromagnetic opening/closing device A in accordance with an embodiment of the present invention. The electromagnetic opening/closing device A includes at least one stationary contact and a moving contact, and is configured to open or close the stationary contact and the moving contact in accordance with an exterior command for opening or closing the stationary contact and the moving contact. In the example of FIG. 1, the electromagnetic opening/closing device A includes a contact unit 1, a drive unit 2, a control unit 3, an input unit 4, a first measurement unit 5, a second measurement unit 6, a malfunction determining unit 7, a storage unit 8, a timer 9, an output unit 10 and the like. The contact unit 1 has two stationary contacts 1A inserted along an electrical circuit 100 and a moving contact (a mover) 1B configured to come into contact with or separate from the stationary contacts 1A. That is, when the moving contact 1B is in contact with the two stationary contacts 1A, the contact unit 1 is closed and the electrical circuit 100 is in a conducting state. When the moving contact 1B is out of contact with the two stationary contacts 1A, the contact unit 1 is opened and the electrical circuit 100 is in a non-conducting state.

The drive unit 2 is configured to move the moving contact 1B to allow it to come into contact with or separate from the stationary contacts 1A. That is, the drive unit is configured to move the moving contact 1B by electromagnetic force generated by allowing an excitation current to flow through an excitation coil 20. The control unit 3 is configured to control the drive unit 2 in accordance with a control signal (an exterior command) supplied from an exterior to the input unit 4. That is, the control unit 3 controls the drive unit 2 to close the contact unit 1 if the input unit 4 receives a close control signal for closing the stationary contacts 1A and the moving contact 1B. The control unit 3 also controls the drive unit 2 to open the contact unit 1 if the input unit 4 receives an open control signal for opening the stationary contacts 1A and the moving contact 1B. The control signal (the close control signal or the open control signal) is a DC voltage signal of which level varies between HIGH and LOW. The close control signal (for turning on contacts) is a high level signal, and the open control signal (for turning off contacts) is a low level signal.

The first measurement unit 5 is configured to obtain a first count based on the number of times a control signal (an exterior command) has been input to the input unit 4. Specifically, the first measurement unit 5 is configured to change the first count based on the number of times a close control signal has been input (e.g., add the number of times to the first count) if the exterior command is the close control signal, where the close control signal is a signal for closing the stationary contacts 1A and the moving contact 1B. The first measurement unit 5 is configured to change the first count based on the number of times an open control signal has been input (e.g., subtract the number of times from the first count) if the exterior command is the open control signal, where the open control signal is a signal for opening the stationary contacts 1A and the moving contact 1B. In the present embodiment, the first measurement unit 5 is configured, if a control signal input to the input unit 4 is a close control signal of which level changes from LOW to HIGH, to add the number of times ("1"), the close control signal has been input, to the first count at a point in time when the level of the close control signal changes to HIGH from LOW. An initial value of the first count is "0" for example. The first measurement unit 5 is configured, if a control signal input to the input unit 4 is an open control signal of which level changes from HIGH to LOW, to subtract the number of times ("1"), the open control signal has been input, from the first count at a point in time when the level of the open control signal changes to LOW from HIGH. The first count obtained from the first measurement unit 5 is stored in the storage unit 8 through the control unit 3.

The second measurement unit 6 is configured to obtain a second count based on the number of times the stationary contacts 1A and the moving contact 1B have been actually opened and closed. Specifically, the second measurement unit 6 is configured: to change, to a specified value (e.g., "1"), the number of times the stationary contacts 1A and the moving contact 1B have been actually closed during a first set time from an input point of a close control signal; and to change the second count by the specified value (e.g., add the specified value to the second count) regardless of the number of times the stationary contacts 1A and the moving contact 1B have been actually opened and closed during the first set time. The second measurement unit 6 is also configured to change the second count by the specified value (e.g., add the specified value to the second count) whenever the stationary contacts 1A and the moving contact 1B are actually opened and then closed after an elapse of the first set time. The second count is stored in the storage unit 8 through the control unit 3.

In the present embodiment, the second measurement unit 6 is configured to measure the number of times the contact unit 1 has been opened and closed, as a tentative count based on displacement of the moving contact 1B, and to store the tentative count in the storage unit 8 through the control unit 3. For example, in the case where auxiliary contacts are provided and configured to link with the contact unit 1 to be opened and closed, the second measurement unit 6 can measure the number of times the contact unit 1 has been opened and closed, as a tentative count from opened and closed states of the auxiliary contacts. It is alternatively possible to measure the number of times the contact unit 1 has been opened and closed, as a tentative count by detecting displacement or position of the moving contact 1B. It is also possible to detect opening and closing of the contact unit 1 based on a voltage applied across the stationary contacts 1A and the moving contact 1B. It is further possible to detect opening and closing of the contact unit 1 by detecting an electric current flowing between the stationary contacts 1A. Examples of the method for detecting displacement or position of the moving contact 1B include detection methods using a proximity switch, a micro switch and the like.

When the contact unit 1 is opened or closed, an intermittent phenomenon of opening and closing called contact bounce (or chattering) occurs. The phenomenon of the contact bounce invariably occurs resulting from the mechanism of the electromagnetic opening/closing device. It is accordingly desirable that the second measurement unit 6 be stopped from counting the number of times the contact unit 1 has been opened and closed by the contact bounce. In the present embodiment, the second measurement unit 6 is configured to obtain the second count (one time in the case of closing) based on the number of times the contact unit 1 has been opened or closed during a set time, from a detected point of opening or closing of the contact unit 1 (after an elapse of contact bounce time in the case of closing).

The second measurement unit 6 is also configured to change the second count by a second specified value (e.g., "1") (e.g., subtract the second specified value from the second count) when the stationary contacts 1A and the moving contact 1B have been actually opened during a second set time from an input point of an open control signal.

The malfunction determining unit 7 is configured to determine a state of the stationary contacts 1A and the moving contact 1B based on the difference between the first count and the second count. In the embodiment, the malfunction determining unit 7 compares an absolute value of the difference between the first count and the second count stored in the storage unit 8 with a predetermined threshold (an upper limit). If the absolute value of the difference is less than the predetermined threshold, the malfunction determining unit determines that malfunction (contact failure) is not present in the contact unit 1. On the other hand, if the absolute value of the difference is equal to or more than the predetermined threshold, the malfunction determining unit 7 determines that malfunction is present in the contact unit 1, and then supplies the determination result to the control unit 3.

Specifically, the malfunction determining unit 7 is configured to output a predetermined first determination result (a determination result that malfunction (contact bounce or chattering) is present in the stationary contacts 1A and the moving contact 1B) if an absolute value of the difference obtained from a close control signal(s) is equal to or more than a first upper limit (at least "1"). The malfunction determining unit 7 is also configured to output a predetermined second determination result (a determination result that malfunction (contact weld) is present in the stationary contacts 1A and the moving contact 1B) if an absolute value of the difference obtained from an open control signal(s) is equal to or more than a second upper limit (e.g., "2").

The control unit 3 is configured to allow the output unit 10 to output a corresponding malfunction detecting signal when receiving a first or second determination result from the malfunction determining unit 7 (a determination result indicating the presence of malfunction). The control unit 3, the input unit 4, the malfunction determining unit 7, the storage unit 8, the timer 9 and the output unit 10 may be each formed of their own individual hardware (circuits), or formed of one microcomputer and various software.

Figure 2:
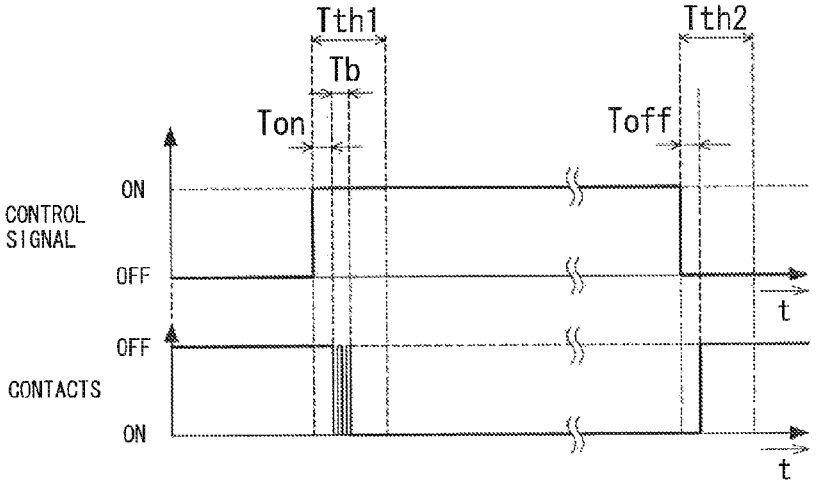
FIG. 2 is a time chart showing a determination process by a malfunction determining unit.

A certain time is required for a period of time from a point in time when a control signal is input to the input unit 4 to a point in time when the drive unit 2 drives the contact unit 1 and an opened or closed state of the contact unit 1 is switched. As shown in FIG. 2, in an electromagnetic relay (the electromagnetic opening/closing device), typically the time required to close contacts is called an operating time Ton, and the time required to open the contacts is called a recovery time Toff. That is, the malfunction determining unit 7 may have difficulty in correctly evaluating the difference between the first count and the second count if the second measurement unit 6 measures the number of times the contact unit 1 is opened or closed during an operating time Ton or a recovery time Toff. It is therefore desirable that the second measurement unit 6 be stopped from measuring the number of times the contact unit 1 has been opened or closed during an operating time Ton or a recovery time Toff.

As shown in FIG. 2, in the embodiment, the second measurement unit 6 uses a first set time Tth1 which includes an operating time Ton and a contact bounce time Tb and is longer than the operating time Ton and the contact bounce time Tb, and also uses a second set time Tth2 which includes a recovery time Toff and is longer than the recovery time Toff. In addition, the first count and the second count are initialized suitably.

In the example of FIG. 2, when a close control signal is input to the input unit 4, the number of times the close control signal has been input ("1") is added to the first count as an initial value (e.g., "0"), and the first count is increased to "1". The stationary contacts 1A and the moving contact 1B are closed during the first set time Tth1 from the input point of the close control signal, and accordingly the specified value (e.g., "1") is added to the second count as an initial value (e.g., "0"), and the second count is increased to "1", regardless of the number of times the stationary contacts 1A and the moving contact 1B have been actually opened and closed during the first set time Tth1. As a result, it is determined that the stationary contacts 1A and the moving contact 1B are in a correctly closed state, because the absolute value of the difference between the first count and the second count is "0" and not equal to or more than the first upper limit (e.g., "1").

When an open control signal is then input to the input unit 4, the number of times the open control signal has been input ("1") is subtracted from the first count, and the first count is decreased to "0". In addition, the stationary contacts 1A and the moving contact 1B are opened during the second set time Tth2 from the input point of the open control signal, and accordingly the second specified value (e.g., "1") is subtracted from the second count, and the second count is decreased to "0". As a result, it is determined that the stationary contacts 1A and the moving contact 1B are in a correctly opened state, because the absolute value of the difference between the first count and the second count is "0" and not equal to or more than the second upper limit (e.g., "1").

Figure 3:
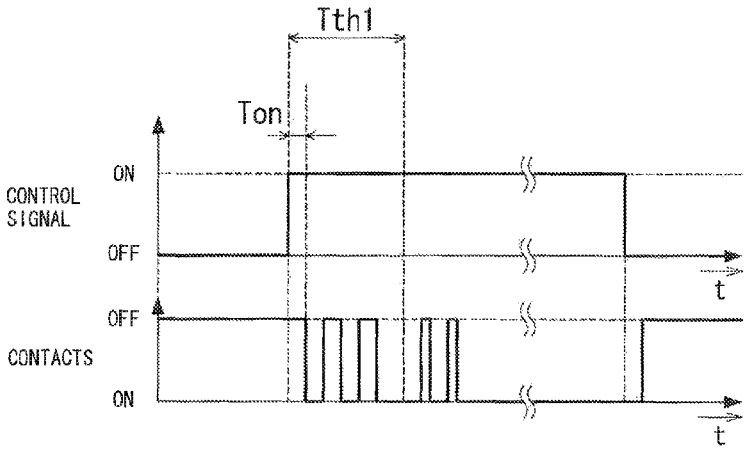
FIG. 3 is a time chart showing a determination process by the malfunction determining unit.

In an example of FIG. 3, when a close control signal is input to the input unit 4, the number of times the close control signal has been input ("1") is added to the first count as an initial value (e.g., "0"), and the first count is increased to "1". In addition, the stationary contacts 1A and the moving contact 1B are closed during the first set time Tth1 from the input point of the close control signal, and accordingly the specified value (e.g., "1") is added to the second count as an initial value (e.g., "0"), and the second count is increased to "1". However, after the elapse of the first set time Tth1, the number of times the stationary contacts 1A and the moving contact 1B have been opened and closed is "2", and accordingly 2× specified value, namely "2" is added to the second count, and the second count is increased to "3". As a result, it is determined that the stationary contacts 1A and the moving contact 1B are not in a correctly closed state, because the absolute value of the difference between the first count and the second count is "2" and exceeds the second upper limit (e.g., "1").

Figure 4:
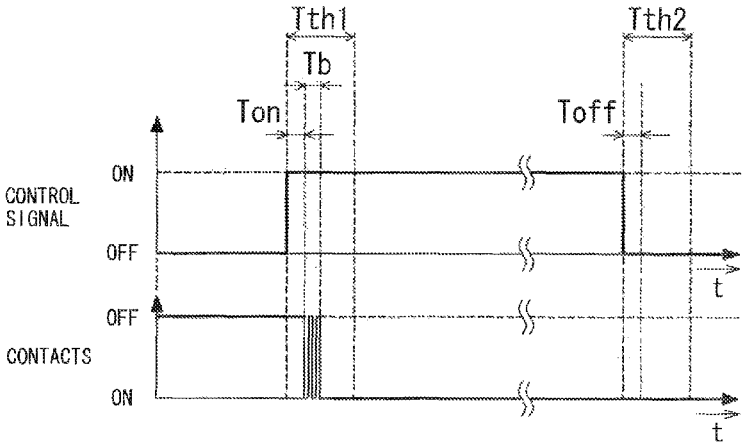
FIG. 4 is a time chart showing a determination process by the malfunction determining unit.

In an example of FIG. 4, when a close control signal is input to the input unit 4, the number of times the close control signal has been input ("1") is added to the first count as an initial value (e.g., "0"), and the first count is increased to "1". In addition, the stationary contacts 1A and the moving contact 1B are closed during the first set time Tth1 from the input point of the close control signal, and accordingly the specified value (e.g., "1") is added to the second count as an initial value (e.g., "0"), and the second count is increased to "1". As a result, it is determined that the stationary contacts 1A and the moving contact 1B are in a correctly closed state, because the absolute value of the difference between the first count and the second count is "0" and not equal to or more than the first upper limit (e.g., "1").

When an open control signal is then input to the input unit 4, the number of times the open control signal has been input ("1") is subtracted from the first count, and the first count is decreased to "0". However, the stationary contacts 1A and the moving contact 1B are not opened during the second set time Tth2 from the input point of the open control signal, and accordingly the second specified value ("1") is not subtracted from the second count. As a result, it is determined that the stationary contacts 1A and the moving contact 1B are not in a correctly opened state, because the second count is kept "1" and the absolute value of the difference between the first count and the second count is "1" and satisfies equal to or more than the second upper limit (e.g., "1").

Thus, the malfunction determining unit 7 can determine that malfunction occurs in the contact unit 1 based on the difference between the first count and the second count, in the case where the number of times of contact bounce increases resulting from wear of the contact unit 1 or a pressure spring for giving pressure to the contact unit 1, or the like. In addition, the malfunction determining unit 7 can determine that malfunction occurs in the contact unit 1 based on the difference between the first count and the second count, in the case where the contact unit 1 is not opened resulting from weld of the contact unit 1 or the like. The determination result by the malfunction determining unit 7 is supplied to an exterior from the output unit 10 through the control unit 3. It is accordingly possible to detect that malfunction occurs in the contact unit 1. The malfunction determination may be performed by individually measuring the number of times the contacts have been opened (an opened count) and the number of times they have been closed (a closed count) through the first measurement unit 5 and the second measurement unit 6 to compare the difference between the opened counts or the difference between the closed counts through the malfunction determining unit 7.

Typically, an operating time Ton and a contact bounce time Tb are specified in such an electromagnetic opening/closing device A (see FIG. 2). The operating time is a period of time from a point in time when a rated voltage is applied across an excitation coil 20 to a point in time when contacts touch each other, and does not include the contact bounce time Tb. Therefore, if the contact bounce continues after the contact bounce time (a standard value) Tb, it may be determined that malfunction occurs in the contact unit 1.

The malfunction determining unit 7 can therefore determine the presence of malfunction when the difference of the number of times the contact unit 1 has been opened and closed is equal to or more than an predetermined upper limit during a set time from an input point of a command, namely during the first set time Tth1, longer than the contact bounce time (the standard value) Tb, from an input point of a close control signal to the input unit 4. That is, the number of times the contact unit 1 has been opened and closed during a contact bounce time Tb is one time, but as the number of times to be counted after the elapse of the contact bounce time Tb increases, the difference between the first count and the second count is larger. Therefore, if the difference between the first count and the second count is equal to or more than the upper limit, the malfunction determining unit 7 can determine that malfunction is present in the contact unit 1.

In an embodiment, the first count includes a first count for close control signal, where an exterior command includes a close control signal for closing the stationary contacts 1A and the moving contact 1B. The first measurement unit 5 is configured to change the first count for close control signal based on the number of times a close control signal has been input if an exterior command is the close control signal. For example, the first measurement unit 5 is configured to add, to the first count for close control signal, the number of times a close control signal has been input if an exterior command is the close control signal. The second count includes a second count for close control signal. The second measurement unit 6 is configured: to change, to a specified value (e.g., "1"), the number of times the stationary contacts 1A and the moving contact 1B have been actually closed during the first set time Tth1 from an input point of a close control signal; and to change the second count for close control signal by the specified value (e.g., add the specified value to the second count) regardless of the number of times the stationary contacts 1A and the moving contact 1B have been actually opened and closed during the first set time Tth1. The second measurement unit is also configured to change the second count for close control signal by the specified value (e.g., add the specified value to the second count for close control signal) whenever the stationary contacts 1A and the moving contact 1B are actually opened and then closed after an elapse of the first set time Tth1.

In addition, the malfunction determining unit 7 is configured to output a predetermined first determination result if an absolute value of the difference between the first count for close control signal and the second count for close control signal is equal to or more than a first upper limit for close control signal. In this embodiment, if the malfunction shown in FIG. 3 is transient malfunction, the transient malfunction can be prevented from being detected. Specifically, in the example of FIG. 3, it is possible to perform a temporary determination that the malfunction of FIG. 3 is transient malfunction if the first upper limit for close control signal is set to 3 or more. When the first upper limit for close control signal is "3" for example, the first count for close control signal and the second count for close control signal are "1" and "3" respectively and an absolute value of the difference thereof is "2", thereby performing a temporary determination that the malfunction of FIG. 3 is transient malfunction. Subsequently, when a close control signal is input again, if the phenomenon of FIG. 3 is present, the first count for close control signal is increased to "2" and the second count for close control signal is increased to, e.g., "6", and an absolute value of the difference thereof is "4". As a result, it is possible to detect the phenomenon of FIG. 3 as malfunction. It is desirable that the first count for close control signal and the second count for close control signal be initialized whenever the number of times the contact unit 1 has been opened and closed reaches a specified value (2 or more, for example, 5, 10 or the like).

Also, in this embodiment, the first count includes a first count for open control signal, and the second count includes a second count for open control signal, where an exterior command includes an open control signal for opening the stationary contacts 1A and the moving contact 1B. In this case, the first measurement unit 5 is configured to change the first count for open control signal based on the number of times an open control signal has been input if an exterior command is the open control signal. For example, the first measurement unit 5 may be configured to add, to the first count for open control signal, the number of times an open control signal has been input if an exterior command is the open control signal. The second measurement unit 6 is configured to change the second count for open control signal by a second specified value (e.g., add the second specified value (e.g., "1") to the second count for open control signal) when the stationary contacts 1A and the moving contact 1B are actually opened during a second set time Tth2 from an input point of an open control signal.

In addition, the malfunction determining unit 7 is configured to output a predetermined second determination result if an absolute value of the difference between the first count for open control signal and the second count for open control signal is equal to or more than a first upper limit for open control signal. The first upper limit for open control signal is set to "1" or more. In an example of FIG. 4 after FIG. 2, if the first upper limit for open control signal is set to "1" for example, it is possible to detect the phenomenon of FIG. 4. That is, in the example of FIG. 4, when an open control signal is input, the first count for open control signal is increased to "2", but the second count for open control signal is kept "1", and therefore an absolute value of the difference thereof is "1". As a result, it is possible to detect the phenomenon of FIG. 4 as malfunction. It is desirable that the first count for open control signal and the second count for open control signal be initialized whenever the number of times the contact unit 1 has been opened and closed reaches a specified value (2 or more, for example, 5, 10 or the like).

Although the present invention has been described with reference to certain preferred embodiments, numerous modifications and variations can be made by those skilled in the art without departing from the true spirit and scope of this invention, namely claims.

The invention claimed is:

1. An electromagnetic opening/closing device, comprising a stationary contact and a moving contact, said electromagnetic opening/closing device being configured to open or close the stationary contact and the moving contact in accordance with an exterior command for opening or closing the stationary contact and the moving contact, wherein the electromagnetic opening/closing device comprises:

a first measurement unit configured to obtain a first count based on the number of times the exterior command has been input;

a second measurement unit configured to obtain a second count based on the number of times the stationary contact and the moving contact have been actually opened or closed;

a determination unit configured to determine a state of the stationary contact and the moving contact based on a difference between the first count and the second count; and an output unit configured to supply an exterior with a determination result by the determination unit.

2. The electromagnetic opening/closing device of claim 1, wherein the determination unit is configured to determine that malfunction is present in the stationary contact and the moving contact if an absolute value of said difference is equal to or more than a predetermined upper limit.

3. The electromagnetic opening/closing device of claim 1, wherein the determination unit is configured to determine that malfunction is present in the stationary contact and the moving contact if an absolute value of said difference is equal to or more than a predetermined upper limit during a set time from an input point of the exterior command.

4. The electromagnetic opening/closing device of claim 1, wherein the first measurement unit is configured to change the first count based on the number of times a close control signal has been input if the exterior command is the close control signal, said close control signal being a signal for closing the stationary contact and the moving contact, and the second measurement unit is configured:

to change, to a specified value, the number of times the stationary contact and the moving contact have been actually closed during a first set time from an input point of the close control signal; to change the second count by the specified value regardless of the number of times the stationary contact and the moving contact have been actually opened and closed during the first set time; and to change the second count by the specified value whenever the stationary contact and the moving contact are actually opened and then closed after an elapse of the first set time.

5. The electromagnetic opening/closing device of claim 1, wherein the first measurement unit is configured to add, to the first count, the number of times a close control signal has been input if the exterior command is the close control signal, said close control signal being a signal for closing the stationary contact and the moving contact, and the second measurement unit is configured:

to change, to a specified value, the number of times the stationary contact and the moving contact have been actually closed during a first set time from an input point of the close control signal; to add the specified value to the second count regardless of the number of times the stationary contact and the moving contact have been actually opened and closed during the first set time; and to add the specified value to the second count whenever the stationary contact and the moving contact are actually opened and then closed after an elapse of the first set time.

6. The electromagnetic opening/closing device of claim 4, wherein the determination unit is configured to output a predetermined first determination result if an absolute value of said difference is equal to or more than a first upper limit.

7. The electromagnetic opening/closing device of claim 1, wherein the first measurement unit is configured to change the first count based on the number of times an open control signal has been input if the exterior command is the open control signal, said open control signal being a signal for opening the stationary contact and the moving contact, and the second measurement unit is configured to change the second count by a second specified value when the stationary contact and the moving contact have been actually opened during a second set time from an input point of the open control signal.

8. The electromagnetic opening/closing device of claim 1, wherein the first measurement unit is configured to subtract, from the first count, the number of times an open control signal has been input if the exterior command is the open control signal, said open control signal being a signal for opening the stationary contact and the moving contact, and the second measurement unit is configured to subtract a second specified value from the second count when the stationary contact and the moving contact have been actually opened during a second set time from an input point of the open control signal.

9. The electromagnetic opening/closing device of claim 7, wherein the determination unit is configured to output a predetermined second determination result if an absolute value of said difference is equal to or more than a second upper limit.

10. The electromagnetic opening/closing device of claim 1, wherein the first count includes a first count for close control signal, said exterior command comprising a close control signal for closing the stationary contact and the moving contact, the first measurement unit is configured to change the first count for close control signal based on the number of times the close control signal has been input if the exterior command is the close control signal, the second count includes a second count for close control signal, and the second measurement unit is configured:

to change, to a specified value, the number of times the stationary contact and the moving contact have been actually closed during a first set time from an input point of the close control signal; to change the second count for close control signal by the specified value regardless of the number of times the stationary contact and the moving contact have been actually opened and closed during the first set time; and to change the second count for close control signal by the specified value whenever the stationary contact and the moving contact are actually opened and then closed after an elapse of the first set time.

11. The electromagnetic opening/closing device of claim 10, wherein the determination unit is configured to output a predetermined first determination result if an absolute value of a difference between the first count for close control signal and the second count for close control signal is equal to or more than a first upper limit for close control signal.

12. The electromagnetic opening/closing device of claim 1, wherein the first count includes a first count for open control signal, said exterior command comprising an open control signal for opening the stationary contact and the moving contact, the first measurement unit is configured to change the first count for open control signal based on the number of times the open control signal has been input if the exterior command is the open control signal for opening the stationary contact and the moving contact, the second count includes a second count for open control signal, and the second measurement unit is configured to change the second count for open control signal by a second specified value when the stationary contact and the moving contact have been actually opened during a second set time from an input point of the open control signal.

13. The electromagnetic opening/closing device of claim 12, wherein the determination unit is configured to output a predetermined second determination result if an absolute value of a difference between the first count for open control signal and the second count for open control signal is equal to or more than a first upper limit for open control signal.

* * * * *